United States Patent [19]

Corrigan et al.

[11] 4,273,576

[45] Jun. 16, 1981

[54] ELECTRIC ARC FURNACE OPERATION

[75] Inventors: James H. Corrigan, Bonao, Dominican Republic; Egil J. Jahnsen, Vaagsbygd, Norway

[73] Assignee: Falconbridge Nickel Mines Limited, Canada

[21] Appl. No.: 121,510

[22] Filed: Feb. 14, 1980

[30] Foreign Application Priority Data

Feb. 16, 1979 [CA] Canada ..... 321687

[51] Int. Cl.[3] ..... C21C 5/52

[52] U.S. Cl. ..... 75/11; 75/10 R; 75/12

[58] Field of Search ..... 75/10–12

[56] References Cited

U.S. PATENT DOCUMENTS 3,715,200 2/1973 Archibald ..... 75/11

*Primary Examiner*—P. D. Rosenberg

*Attorney, Agent, or Firm*—Bacon & Thomas

[57] ABSTRACT

An improved method is described for the continuous shielded arc melting of calcine in an electric arc furnace to obtain molten slag, underlain by molten metal.

The furnace is so operated that the major portion of the total energy supplied thereto is released in the arc, and the minor portion in the molten bath. The improvement consists of adjusting the electrical energy released in the bath, directly to obtaining a required active bath area calculated by means of the rate of change in the volume of the slag and indirectly to the silica:magnesia ratio in the slag. The optimum range of active bath area is derived from conditions required for the safe and continuous operation of the furnace, in order to protect the furnace walls from slag erosion and to avoid excessive electrode movement.

2 Claims, 4 Drawing Figures

ELECTRIC ARC FURNACE OPERATION

This invention is related to electric arc furnace technology utilized in melting particulate materials, and is particularly directed to the recovery of ferronickel from nickeliferous lateritic ores which have variations in the silica and magnesia contents of their slag-making constituents.

Electric furnace practice for obtaining metal values from ores can be divided into three broad types witth respect to the position of the electrode in relation to the molten bath:

(i) Immersed Electrode
(ii) Submerged Arc
(iii) Open (raised) Arc

In the last type the electrode is positioned above the molten bath and an arc is generated between the electrode and the bath. A particular type of electric arc furnace smelting, a combination of open and submerged arc operations defined as shielded arc melting, is described in U.S. Pat. No. 3,715,200, wherein the arc is shielded by the charge fed from the roof of the furnace. Because the charge is free-flowing and substantially non-conductive, it always completely surrounds the arc and the lower portion of the adjustable electrode. The roof and walls of the furnace are thus protected from excessive heat. Since most of the melting of the charge takes place in the arc, above the bath, the energy released in the bath is primarily utilized in maintaining the slag at a temperature at which the molten metal will separate therefrom and form a pool overlain by molten slag. This mode of operation is consistent with a ratio of arc power ($P_A$) to bath power ($P_B$) in excess of unity. The ratio may be expressed as:

$$\frac{P_A}{P_B} = \frac{V_T^2}{P_T R_B} - 1 = \frac{V_T}{IR_B} - 1 \quad (1)$$

where $V_T$=phase voltage
$P_T$=Total phase power (volts)
$R_B$=Bath resistance (ohms) and
I=Current (amperes)

The power factor has an assumed value of unity.

The slag layer is maintained as shallow as possible thereby requiring the least amount of power release therein to maintain desired slag and metal temperatures, and voltage and arc length are adjusted in relation to the resulting power input so that the amount of power actually released in the slag, while sufficient to maintain the bulk of the slag and metal at tapping temperatures, is advantageously insufficient to permit molten slag to exist in contact with the refractory walls of the furnace. Temperature gradients are such that the walls are protected by a layer of frozen slag thereby preventing erosion. Heat losses are therefore reduced and at the same time the major portion of the power is released in the arc for generation of heat therein that is utilized efficiently for rapid melting of particles at high temperatures in the shielded arc melting zone.

In essence the invention involves improvements in the adjustment of that portion of the energy released in the molten bath to allow the separation of metal values from slag-making constituents, while maintaining optimum conditions for the protection of the refractory lining and the electrodes.

This invention is directed to the continuous shielded arc melting of particulate material which contains metal values and a preponderance of slag-making constituents including silica and magnesia, by establishing, in an electric arc furnace having a refractory lining and a given hearth area, a bath resulting from the said melting of particulate material overlying the bath and a protective crust of solidified bath material and unmelted particulate material between the walls of the furnace and the bath, whereby a major portion of the electrical energy supplied to the furnace is released in the shielded arc and a minor portion of said electrical energy is released in the bath, and to the improvement comprising, (a) determining the rate of change of bath volume coincident with a rate of change of bath level in the furnace,
(b) dividing the rate of change of bath volume by that of bath level to obtain an active bath area, and,
(c) adjusting the ratio of energy released in the arc to that released in the bath to maintain a predetermined active bath area.

The invention will now be described with reference to the accompanying drawings in which.

In an advantageous embodiment of the invention, an electric furnace for melting particulate matter as shown in FIG. 1 is charged with calcined particles of lateritic ore of size ½" and larger. The calcine has been reduced prior to feeding to the electric furnace, contains less than 0.5% carbon and is substantially electrically non-conductive; it is composed of a preponderance of slag-making constituents, largely silica and magnesia, and of metallized constituents dispersed through the matrix of the calcine. The object of the electric arc treatment of the calcine is to separate by melting the metal values from the slag-making constituents. The separated metal values, e.g. ferronickel, collect in the bottom of the furnace, as a pool of metal overlain by molten slag. The slag temperature is at its highest in the vicinity of the arc and is lower at some distance away near the furnace walls. Consequently some slag solidifies, forming a crust along the walls. The exact shape of the crust formed is not known, and it is not possible to estimate its thickness and distribution below the molten slag level. Where the molten slag level meets the walls shelves of solidified slag are formed, due to the cooling effect of unmelted calcine feed, although the thickness of such shelves cannot be assessed during operation. In any case, it is not feasible to determine by direct measurement the actual surface area of the molten bath and compare it to the nominal hearth area of of the furnace, as described below. The advantage of the solidified crust is that it protects the refractory lining of the furnace walls from slag erosion and assists in extending the life of the furnace. However, it is found that too extensive slag crust formation considerably diminishes the area and space in which melting and separation of metal values can take place. In an extreme case the crust may extend to the vicinity of the electrodes, resulting in a very narrow bath and large slag level changes occasioned by tapping, impeding vertical movement of the electrodes and even leading to breakage thereof.

Figure 1B:
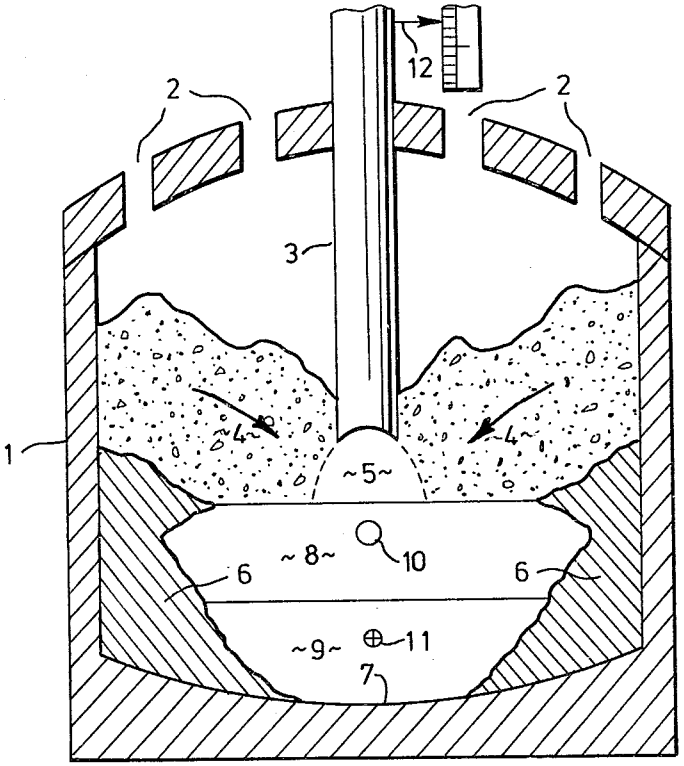
FIG. 1 shows schematic diagrams of the arc furnace, the hearth and the melting area, with the slag level immediately after tapping illustrated in FIG. 1A, and between tapping, when the slag level has risen due to melting of fed calcine, being illustrated in FIG. 1B.
Figure 1A:
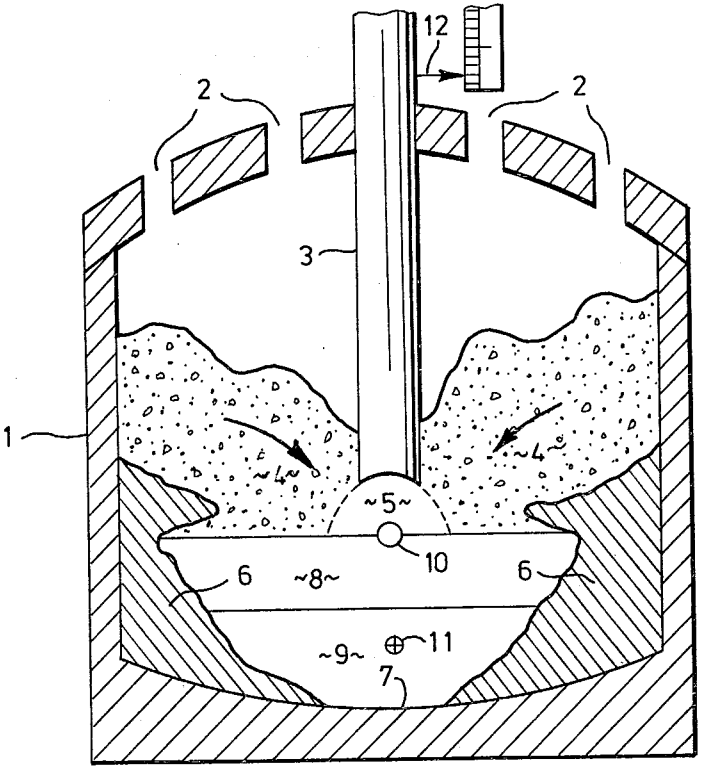

The furnace of FIG. 1 has refractory lined furnace walls, 1, with ports, 2, in the roof for charging calcine to the furnace. The furnace has adjustable electrodes but only one electrode, 3, is shown in FIG. 1, surrounded by unmelted calcine, 4. Calcine is continuously moving downwards as shown by arrows due to melting in arc, 5. Molten slag bath, 8, formed is encased by slag crust, 6, solidified along the furnace walls, 1, but it should be emphasized that the shape of the crust is only estimated and the measurement of its real shape cannot be actually ascertained. The molten slag, 8, is shown to lie over a molten pool of metal, 9. The nominal area of the furnace hearth, 7, is taken to be between the vertical side walls, 1, and the end walls, not shown, covering the hearth, 7. A slag taphole, 10, is positioned above a metal taphole, 11. FIG. 1A shows the slag level after tapping, and FIG. 1B, between tapping operations. The change in slag level due to tapping or to further melting of calcine, is translated to vertical movements by the electrode, and a movement indicator, 12, shown schematically, permits the direct measurement of the rate of change of bath level coincident with the rate of change of slag volume. It is a well-known practice in furnace melting technology to derive the volume of the bath tapped by means of weighing and to determine the change in bath level by measurement of the vertical displacement of the electrodes, but any other method may be used. In the present invention the ABA% is determined by measuring the rate of change of bath volume divided by the rate of change in bath level and by the nominal hearth area.

Thus the ABA%, that is the ratio of the apparent molten slag surface to the base area of the hearth, can be assessed from measured furnace operating parameters:

$$ABA\ \% = \frac{\text{Weight of slag tapped per hour}}{\text{Specific gravity of slag}} \times \frac{1}{\text{Bath level change per hour}} \times \frac{100}{\text{Nominal hearth area}}$$

The change in volume of the bath may be determined either as that occurring due to tapping or due to the increase by melting further charge.

The ABA is a value obtained by furnace operating parameters and it gives a measure of the openness of the bath, or in other words, a method for estimating the width of the bath wherein the melting reactions can take place. The ABA is best expressed as a fraction of the nominal hearth area. It is to be stressed that the active bath area is only an averaged value which allows those skilled in the art to estimate the surface of the molten slag, in place of a real bath area, that cannot be measured during operation, and in any case, undergoes hour-to-hour variations in configuration. For a given furnace operation the active bath area is a function of the silica:magnesia content of the slag-making constituents, and also of the energy released to keep the bath molten. The bath power is held at a level to maintain the operation of the furnace at the most advantageous active bath area. The method described in the present invention aims at showing how the knowledge of the silica:magnesia ratio in the slag can be utilized in selecting the most advantageous active bath area ratio for melting calcine and obtaining metal values in a shielded arc electric furnace operation.

It has been found that for lateritic ores which have been calcined and subsequently melted according to an advantageous embodiment of this invention, the upper limit for safe operation of the furnace is about 60 percent active bath area, with a lower limit of about 30 percent, for silica-rich slag compositions from melted ore. In the case of lateritic ores having a relatively lower silica:magnesia ratio, such as 1.3, the active bath area is controlled, in accordance with the present invention, between about 20 and 40 percent.

It is to be noted that, when the particulate material is calcined nickeliferous lateritic ore having a silica:magnesia ratio between 1.3 and 2.0 on a weight percent basis, the active bath area, expressed as a fraction of the furnace hearth area, is controlled to between 0.15 and 0.30 times the silica:magnesia ratio in order to minimize the amount of solid and solidified material surrounding and in the bath consistent with preventing erosion of the refractory lining.

Figure 2:
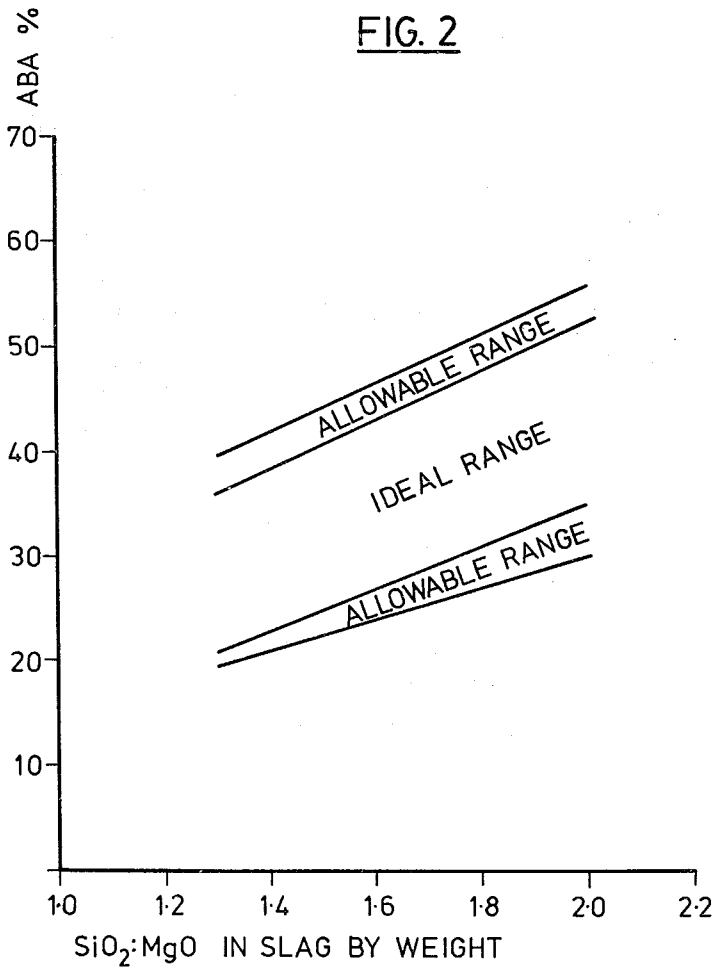
FIG. 2 represents a relationship between the percent active bath area (hereinafter referred to as ABA) and the silica:magnesia ration, by weight, in the slag found experimentally by the method described in the present invention.

Referring to FIG. 2, the ABA% derived, as described hereinabove, is plotted against the silica:magnesia ratio present in the slag, showing an "ideal range" for each variable, in which the furnace operation is most advantageous, and "allowable ranges" wherein the operation is acceptable. As taught in the above cited patent, if the power released in the bath is too high, the active bath area will be increased, melting the protective solidified crust away, and the slag can damage, and even penetrate the refractory lining. On the other hand, if the power released in the bath is insufficient for a given slag composition, a gradual narrowing of the bath will ensue, reducing the volume of the molten slag step by step, leading to a diminishing rate in the desired separation of metal values, and eventually, to operating conditions which are likely to result in electrode breakage. Thus FIG. 2 shows, according to this invention, the conditions in an advantageous embodiment for optimum melting and ferronickel production, taking into consideration the silica and magnesia contents of the slag-making constituents of the calcine.

Figure 3:
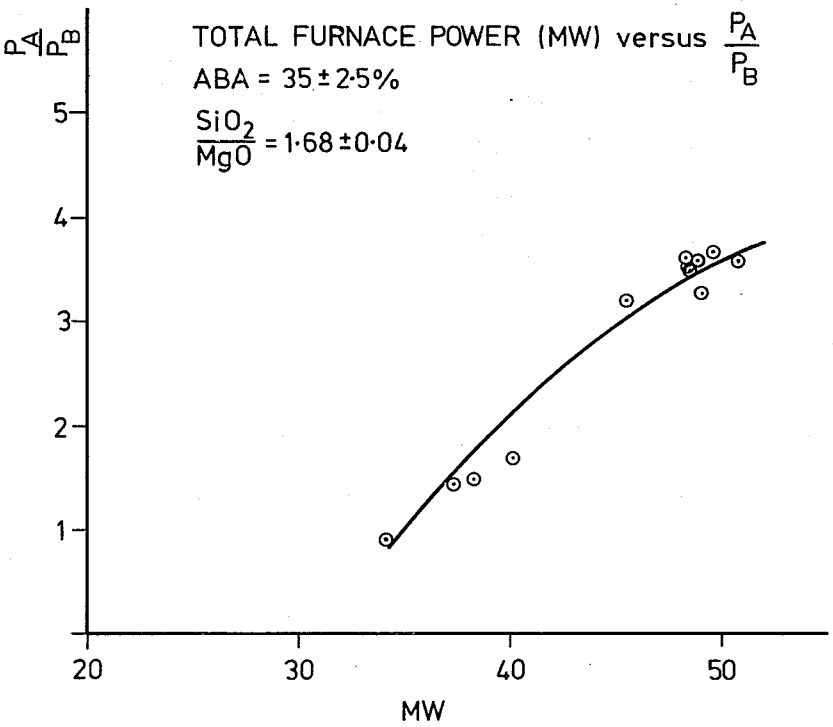
FIG. 3 shows the relationship between the total furnace power and the arc power—bath power ratio ($P_A/P_B$) for a given value of active bath area ratio (ABA%)

The method of operation of a shielded arc furnace described in U.S. Pat. No. 3,715,200 requires arc power to bath power ratios which are greater than unity, and in accordance with that invention it is possible to increase the total energy input to the electric arc furnace and simultaneously operate at a relatively diminished current. FIG. 3 shows a curve obtained when the total furnace power is plotted against arc power—bath power ratio. This diagram indicates the required control of the arc power—bath power ratio as the total power to the furnace is increased, or decreased as the case may be, to keep within a selected range of active bath area ratio. FIG. 3 depicts the case where the active bath area was controlled around the value of 35%. The silica:magnesia ratio by weight of the slag was $1.68 \pm 0.04$ and can be seen to fall well within the ideal range shown in FIG. 2. Similar total furnace power versus $P_A/P_B$ relationships can be obtained for other required active bath area ranges, which are selected in view of the silica:magnesia ratio of the slag. Thus in an advantageous embodiment of this invention an electric arc furnace is operated for the purpose of obtaining ferronickel, at a relatively low current, while minimizing heat losses and while controlling the active bath area at a value which is most advantageous for the silica:magnesia ratio contained in the slag-making constituents in the calcine.

Figure 4:
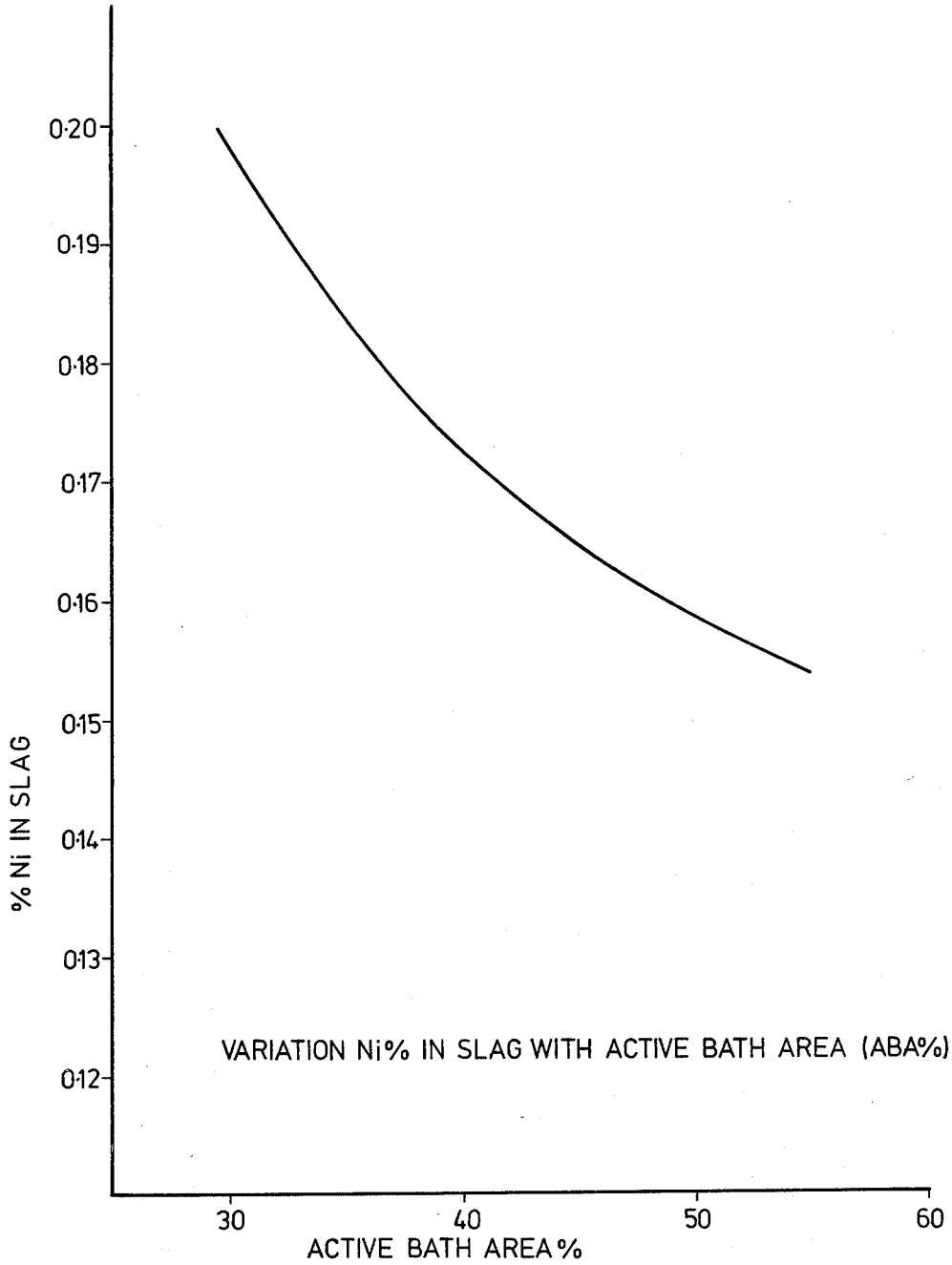
FIG. 4 represents the variation of metal contained in the slag with the ABA%.

Another aspect governing the advantageous operation of shielded arc melting is the minimization of metal losses in the slag. A portion of the metal lost in the slag is held as dissolved metal. A high proportion of slag losses occur in the form of tiny droplets of metal dispersed through the bulk of the slag which freeze in on cooling. An electric arc furnace operated at a relatively narrow active bath area, impedes the nucleation and eventual sinking to the metal pool of such dispersed metal droplets. FIG. 4 shows the relationship between the nickel values lost in the slag and the ABA%. It has been demonstrated in the literature dealing with slag chemistry, that the viscosity of a slag is tied closely to its silica content, more particularly to the silica/alkali metal ion ratio. Thus a relationship exists between the silica:magnesia ratio of the slag and the nucleation and settling rate of the dispersed metal droplets, which is not, however, contemplated by the present invention.

The advantage offered by this invention in controlling the active bath area while operating the furnace at an optimum power division between arc and bath, and suitable for the particular silica:magnesia content of the slag, is illustrated in the following examples.

EXAMPLE 1

Calcined lateritic ore having a $SiO_2$ to MgO ratio of 1.66 was charged to an electric arc furnace in accordance with the principles of shielded arc operation, as described in U.S. Pat. No. 3,715,200. The furnace was operated at an average energy rate corresponding to 43 MW, and at a phase voltage of 1265 V. The ratio of power released in the arcs to that released in the bath was controlled by varying the length of the arcs. The percent active bath area was determined by measuring a rate of volume of slag tapped coincident with the rate of drop in bath level as described herein. It was found that the maximum active bath area consistent with adequate wall protection, slag fluidity and metal separation was 45% of the nominal hearth area, and that this condition occurred when the ratio of power released in the arc to that released in the bath, i.e., $P_A/P_B$ amounted to 4.3:1.

EXAMPLE 2

Calcined lateritic ore having a silica to magnesia ratio of 1.54, was charged to the electric arc furnace used in Example 1. The furnace was operated at an average rate of 41 MW, and a phase voltage of 945 V. The active bath area was calculated according to the method described hereinabove by measuring the rate of volume of the slag tapped. It was found that the active bath area consistent with advantageous furnace operation and tapping conditions was 35% of the nominal hearth area. This active bath area was obtained when the ratio of the power released in the arcs to that released in the bath, $P_A/P_B$ was equal to 2.24.

EXAMPLE 3

The shielded arc electric furnace used in Examples 1 and 2 was operated at a total power rate of 23.3 MW for several days. The following operating figures were recorded:

| Day | $SiO_2MgO$ in Slag | % Active Bath Area |
|---|---|---|
| 2 | 1.72 | 55 |
| 3 | 1.76 | 62 |
| 4 | 1.70 | 70 |

On the fifth day molten slag eroded the furnace lining and ran out.

EXAMPLE 4

The electric arc furnace used in the previous examples was operated at an arc power to bath power ratio in excess of 5. The slag obtained was found to be viscous, slag tapping conditions were slow, and conditions existed which could lead to fouling of the electrodes. The silica:magnesia ratio of the slag was 1.60 and the ABA% was about 20%. Nickel lost in the slag was excessive. Bath power and current were subsequently increased to improve tapping conditions.

An improved method of operating an electric arc furnace is described in the present invention. The method as described herein represents the best mode of operation known to the inventors, but other modifications and variations may be apparent to those skilled in the art, without deviating from the spirit and scope of this invention.

We claim:

1. In the method of conducting the continuous shielded arc melting of particulate material containing metal values and a preponderence of slag-making constituents including silica and magnesia, by establishing, in an electric arc furnace having a refractory lining and a given hearth area, a bath resulting from the said melting of particulate material overlying the bath and a protective crust of solidified bath material and unmelted particulate material between the refractory lining and the bath, whereby a major portion of the electrical energy supplied to the furnace is released in the shielded arc and a minor portion of said energy is released in the bath, the improvement comprising, (a) determining, by slag weight and bath level measurements, the rate of change of bath volume coincident with a measured rate of change of bath level in the furnace, (b) dividing the rate of change of bath volume by that of bath level to obtain an active bath area, and (c) adjusting the ratio of energy released in the arc to that released in the bath, by regulating the fraction of the total power fed to the bath, to maintain a predetermined active bath area.

2. Method according to claim 1 in which the particulate material is calcined nickeliferous lateritic ore having a silica:magnesia ratio between 1.3 and 2.0 on a weight percent basis and the active bath area, expressed as a fraction of the furnace hearth area, and the fraction of the total power fed to the bath is controlled to provide an active bath area between 0.15 and 0.30 times the silica:magnesia ratio to minimize the amount of solid and solidified material surrounding and in the bath consistent with preventing erosion of the refractory lining.

* * * * *